US006672409B1

(12) United States Patent
Dock et al.

(10) Patent No.: US 6,672,409 B1
(45) Date of Patent: Jan. 6, 2004

(54) DOWNHOLE GENERATOR FOR HORIZONTAL DIRECTIONAL DRILLING

(75) Inventors: Matthew L. Dock, Stillwater, OK (US); Brent G. Stephenson, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 09/695,156

(22) Filed: Oct. 24, 2000

(51) Int. Cl.[7] ..... E21B 4/02; E21B 7/01

(52) U.S. Cl. ..... 175/107; 175/101; 175/62; 166/66.5

(58) Field of Search ..... 166/66.5; 175/62, 175/93, 92, 100, 101, 107

(56) References Cited

U.S. PATENT DOCUMENTS

| | | | |
|---|---|---|---|
| 3,583,502 A | 6/1971 | Henderson | 175/107 |
| 3,702,938 A | 11/1972 | Garnier | 290/52 |
| 3,819,293 A | 6/1974 | Zitmann | 415/200 |
| 3,949,354 A | 4/1976 | Claycomb | 340/18 |
| 3,970,877 A | 7/1976 | Russell et al. | 310/8.3 |

(List continued on next page.)

FOREIGN PATENT DOCUMENTS

| | | | |
|---|---|---|---|
| DE | 197 06 371 A1 | 8/1998 | E21B/4/04 |
| DE | 199 55 345 A1 | 6/2001 | E21B/4/02 |
| EP | 0 520 733 A1 | 12/1992 | E21B/7/06 |
| EP | 0 747 568 A2 | 12/1996 | E21B/41/00 |
| GB | 2 346 509 A | 8/2000 | E21B/47/12 |
| WO | WO 01/51761 A1 | 7/2001 | E21B/17/10 |

*Primary Examiner*—David Bagnell
*Assistant Examiner*—Jennifer H Gay
(74) *Attorney, Agent, or Firm*—McKinney & Stringer, P.C.

(57) ABSTRACT

A generator assembly for generating power in the downhole end of a drill string used to form a borehole in horizontal directional drilling. The drill string provides a fluid passageway in which the downhole generator is receivingly disposed, at least in part, to subject a rotatable turbine to a pressurized fluid flowing in the fluid passageway, thereby imparting a mechanical rotation to the turbine. The turbine is coupled to a generator so that the mechanical rotation of the turbine is transferred to a power output of the generator.

25 Claims, 8 Drawing Sheets

U.S. PATENT DOCUMENTS

| | | | | |
|---|---|---|---|---|
| 3,982,224 | A | 9/1976 | Patton | 340/18 |
| 3,997,867 | A | 12/1976 | Claycomb | 340/18 |
| 4,080,112 | A | 3/1978 | Zimmermann | 417/420 |
| 4,184,545 | A | 1/1980 | Claycomb | 166/113 |
| RE30,246 | E | 4/1980 | Richter, Jr. et al. | 175/65 |
| 4,207,485 | A | 6/1980 | Silver | 310/104 |
| 4,215,426 | A | 7/1980 | Klatt | 367/83 |
| 4,351,037 | A | 9/1982 | Scherbatskoy | 367/85 |
| 4,396,071 | A | 8/1983 | Stephens | 175/50 |
| 4,491,738 | A | 1/1985 | Kamp | 290/43 |
| 4,515,225 | A | 5/1985 | Dailey | 175/40 |
| 4,518,888 | A | 5/1985 | Zabcik | 310/334 |
| 4,532,614 | A | 7/1985 | Peppers | 367/81 |
| 4,562,560 | A | 12/1985 | Kamp | 367/83 |
| 4,654,537 | A | 3/1987 | Gaspard et al. | 290/54 |
| 4,675,852 | A | 6/1987 | Russell et al. | 367/84 |
| 4,725,197 | A | 2/1988 | Russell et al. | 415/104 |
| 4,732,225 | A | 3/1988 | Jurgens et al. | 175/92 |
| 4,739,325 | A | 4/1988 | MacLeod | 340/854 |
| 4,785,300 | A | 11/1988 | Chin et al. | 340/861 |
| 4,802,150 | A | 1/1989 | Russell et al. | 367/85 |
| 4,844,707 | A | 7/1989 | Kletschka | 417/420 |
| 4,847,815 | A | 7/1989 | Malone | 367/84 |
| 4,956,823 | A | 9/1990 | Russell et al. | 367/84 |
| 5,017,103 | A | 5/1991 | Dahl | 417/420 |
| 5,145,333 | A | 9/1992 | Smith | 417/405 |
| 5,149,984 | A | 9/1992 | Schultz | 290/54 |
| 5,179,040 | A | 1/1993 | Hattori | 437/129 |
| 5,182,731 | A | 1/1993 | Hoelscher et al. | 367/84 |
| 5,195,877 | A | 3/1993 | Kletschka | 417/356 |
| 5,215,152 | A | 6/1993 | Duckworth | 175/48 |
| 5,248,896 | A | 9/1993 | Forrest | 290/1 |
| 5,285,204 | A | 2/1994 | Sas-Jaworsky | 340/854.9 |
| 5,322,413 | A | 6/1994 | Vescovini et al. | 415/102 |
| 5,402,068 | A | 3/1995 | Meador et al. | 324/338 |
| 5,448,227 | A | 9/1995 | Orban et al. | 340/854.4 |
| 5,583,827 | A | 12/1996 | Chin | 367/84 |
| 5,586,083 | A | 12/1996 | Chin et al. | 367/84 |
| 5,615,172 | A | 3/1997 | Kotlyar | 367/83 |
| 5,695,015 | A | 12/1997 | Barr et al. | 175/45 |
| 5,787,052 | A | 7/1998 | Gardner et al. | 367/84 |
| 5,812,068 | A | 9/1998 | Wisler et al. | 340/855.5 |
| 5,813,480 | A | 9/1998 | Zaleski, Jr. et al. | 175/40 |
| 5,818,352 | A | 10/1998 | McClure | 340/854.6 |
| 5,839,508 | A | 11/1998 | Tubel et al. | 166/65.1 |

DOWNHOLE GENERATOR FOR HORIZONTAL DIRECTIONAL DRILLING

FIELD OF THE INVENTION

The present invention relates to the field of horizontal directional drilling of boreholes, and in particular but not by way of limitation, to an apparatus and an associated method for generating power in the downhole end of a drill string used in near surface horizontal directional drilling.

SUMMARY OF THE INVENTION

A horizontal directional drilling machine is provided that acts on a drill string to form a borehole in the subterranean earth. The drill string has a fluid flow passage for the pumping of a pressurized fluid to the downhole end of the drill string to aid in the formation of the borehole. A generator assembly is disposed, at least in part, in the fluid flow passage and is responsive to the fluid flowing in the fluid flow passage to generate power to meet the downhole power requirements associated with horizontal directional drilling.

In one embodiment of the present invention the generator assembly has a housing supportable in the drill string so as to place a cavity formed within the housing in the fluid flow passage. An inlet in the housing directs the pressurized fluid into the cavity. An outlet is furthermore provided in the housing permitting an egress of fluid from the cavity.

An impeller is supported in the cavity for mechanical rotation in response to an impinging engagement of the pressurized fluid flowing from the inlet to the outlet. A generator is coupled to the impeller to convert the mechanical rotation to a power output.

Other aspects and advantages of the present invention are apparent from the description below and appended claims.

BRIEF DESCRIPTION OF THE DRAWINGS

FIG. 8 is a diagrammatic partial cross sectional view similar to FIG. 3 with the generator assembly disposed in an alternative position within the tool head.

FIG. 9 is a diagrammatic partial cross sectional view of the generator assembly of FIG. 8.

BACKGROUND OF THE INVENTION

Figure 1:
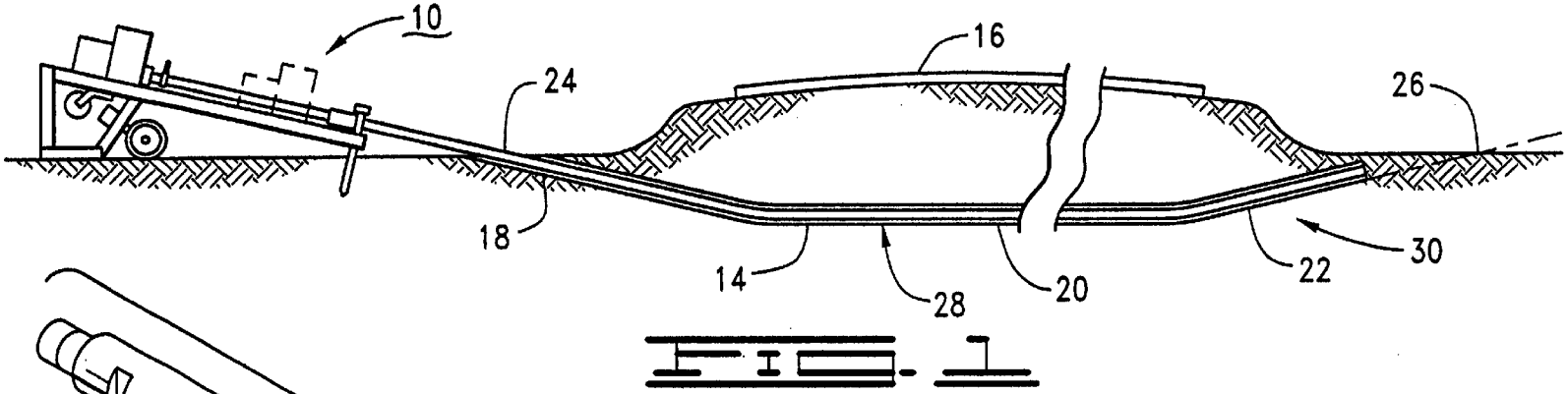
FIG. 1 is a diagrammatic representation of a near surface horizontal directional drilling machine acting on an uphole end of a drill string which, in turn, supports a downhole generator that is constructed in accordance with the present invention.

Near surface horizontal directional drilling is a widely-used method of producing subterranean boreholes for the routing of underground utilities. On a larger scale, horizontal directional drilling can be used to place pipelines beneath above-ground obstacles such as roadways or waterways. This is accomplished by drilling an inclined entry borehole segment downward through the earth surface, then drilling substantially horizontally under the obstacle, then upwardly through the earth surface on the other side of the obstacle as in accordance with, for example, U.S. Pat. No. 5,242,026, entitled METHOD AND APPARATUS FOR DRILLING A HORIZONTAL CONTROLLED BOREHOLE IN THE EARTH; issued to Deken et al. and assigned to the assignee of the present invention. Usually a pilot bore is drilled in this manner and then a final reaming operation is performed to produce the desired borehole. In any event, the pipeline or other "product" being installed can then be pulled into the borehole. Advantageously, all this is done without disturbing the structure or the use of the obstacle. On a smaller scale, electrical lines can be routed beneath fences and driveways in a similar manner.

Conventionally, a horizontal directional drilling machine acts on a drill string to produce the pilot hole. The drilling machine imparts rotational and thrust forces to an upper end of the drill string to rotate and advance a bit attached to the lower, or downhole, end of the drill string. The downhole end of the drill string is adapted to selectively guide the bit so as to steer the downhole end of the drill string.

One way of steering the downhole end of the drill string is with a slanted face bit. When the drill string is simultaneously rotated and advanced, the offset bit forms a pilot hole in a substantially straight direction. But when the drill string is advanced without rotation, the bit pierces the subterranean earth and veers in a different direction, as determined by the angle of the slanted face and the rotational orientation of the drill string.

The bit is supported by a tool head attached to the downhole end of the drill string. The tool head location can be tracked for steering and direction-control to ensure that underground obstacles, such as pipelines or electrical lines are avoided. One common way of tracking involves positioning a transmitter in the tool head that emits a signal, and detecting the signal with a receiver that is positioned above ground. Typically, the receiver is a portable device controlled by an operator above ground. Some receivers detect not only the location but also orientation and status information of the tool head. Information such as roll, pitch, and azimuth, allows the drilling machine operator to determine rotational orientation of the tool head in order to selectively change direction of the bore when the drill string is advanced without rotation. Other conditions are also monitored such as tool head temperature, battery status, etc.

Advancements in horizontal directional drilling have been realized, but unresolved difficulties remain. For example, tracking devices are limited by power constraints of the transmitter. The demand for more information from the transmitter has outpaced advancements in the traditional way of powering the transmitter. Generally, the transmitter emits a signal that is detectable within a characteristic dipole magnetic field surrounding the transmitter. In most cases, the transmitter uses a battery which provides a relatively weak-powered signal. As a result, the effective detection range of the dipole magnetic field generated by the transmitter is limited by the weak signal. This can be problematic at times, such as when drilling under roadways or waterways. Clearly, more powerful transmitters are desirable in that they permit deeper tracking as a result of their larger dipole magnetic field. Furthermore, the finite life of a battery means that when the battery is dissipated, the drill string must be withdrawn from the borehole in order to replace it.

In other cases the transmitter is powered by a wire-line electrical connection. Such a connection is difficult to maintain in the relatively harsh environment associated with subterranean directional drilling. The self-contained nature of a battery powered transmitter is preferable in many cases, despite the problem of limited power.

There is a long felt need in the industry for a self contained electrical power generating assembly to provide a continuous power supply adapted to meet the ever-increasing electrical power requirements associated with horizontal directional drilling.

DETAILED DESCRIPTION OF THE PREFERRED EMBODIMENTS

Beginning with FIG. 1 which is a diagrammatical representation of a drilling machine 10 forming a borehole 14 into the subterranean earth. The borehole 14 is selectively formed within a predetermined zone of safe passage to avoid underground objects and above-ground obstacles that would otherwise be disturbed by conventional methods, such as trenching and backfilling.

It will be noted that FIG. 1, for example, illustrates some of the advantages of horizontal directional drilling under a roadway 16. The direction of the borehole 14 can be selectively changed, from the downwardly directed portion 18 to the horizontally directed portion 20 and then to the upwardly directed portion 22. Also advantageous, but not limiting, is the ability to provide an entry portion 24 and an exit portion 26 of the borehole 14 at the earth's surface, thereby eliminating the need to excavate entry and exit pits as is common with other methods of subterranean drilling.

Figure 2:
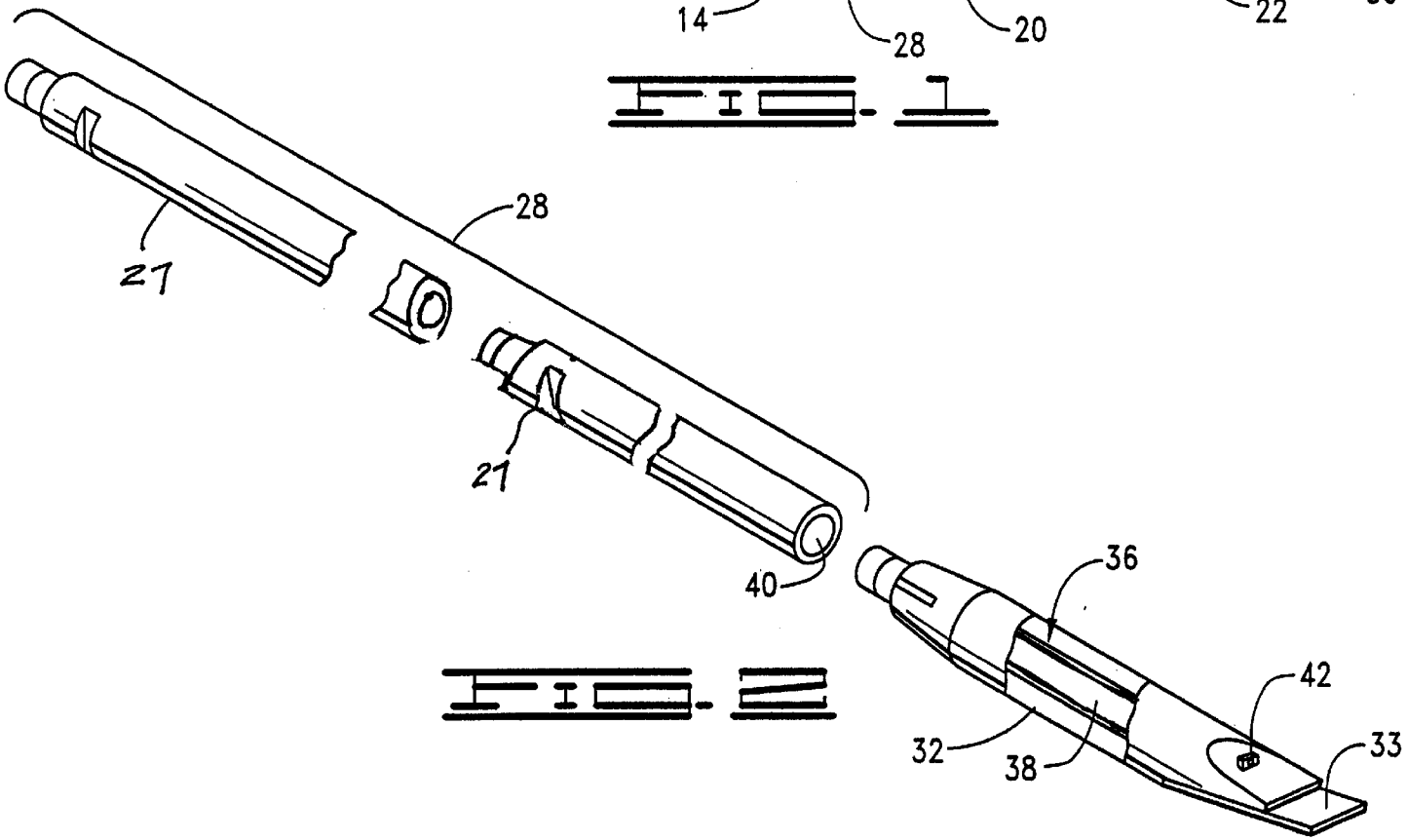
FIG. 2 is an exploded, partially broken away, isometric view of the downhole portion of the drill string.

Turning now to FIG. 2, which is an exploded isometric view of a downhole portion of a drill string assembly 28. The drill string assembly 28 is made up of a plurality of annular drilling members, such as drill pipes 27, and a tool head 32 is attached to a distal end of the drill string assembly 28. A bit 33 is attached to the tool head 32. The drilling machine 10 (FIG. 1) acts on the drill string 28 to rotate and/or thrust the bit 33 through the subterranean earth.

An electronic transmitter 38 can be employed for use with an above-ground receiver (not shown) to track the subterranean location of the tool head 32 during drilling or backreaming operations. Placing the transmitter 38 in the tool head 32 aids the drilling machine 10 operator in steering the bit 33. It will be noted the tool head 32 of FIG. 2 is partially broken away to reveal a chamber 36 in the tool head 32 for receiving disposition of the transmitter 38.

Heat build-up is a concern for both the transmitter 38 and the bit 33. Heat is generated by frictional forces created as the bit 33 engages the subterranean earth. A drilling fluid is commonly pumped through the drill string 28 and the tool head 32 and sprayed onto or near the bit 33 for cooling and lubricating the bit 33. While flowing past the transmitter 38 and before being sprayed onto the bit 33, the drilling fluid cools the transmitter 38.

Figure 3:
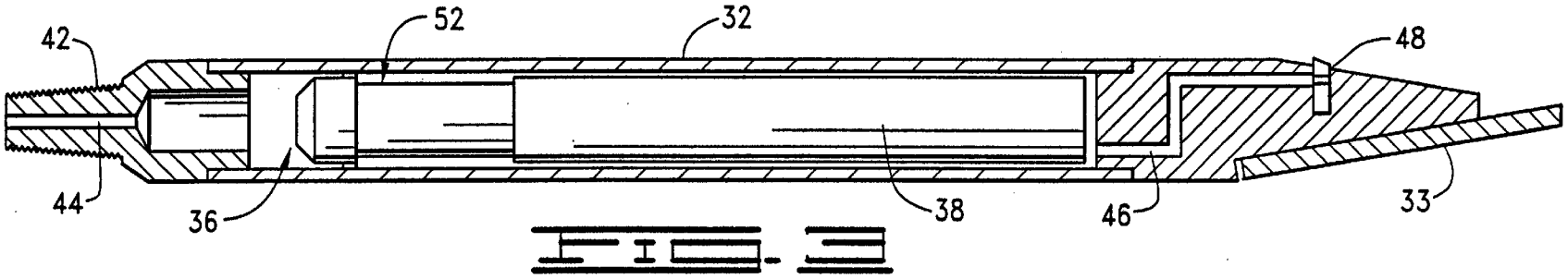
FIG. 3 is a diagrammatic partial cross sectional view of the tool head of FIG. 2 with a generator assembly and a transmitter disposed in the tool head.

A continuous fluid flow passage is thus necessary from the upper end of the drill string 28 to the lower end of the tool head 32. For example, the drill string 28 can have a longitudinal bore 40 fluidly connected with the chamber 36 in the tool head 32, wherein the transmitter 38 is receivingly disposed. FIG. 3 illustrates the tool head 32 can have a connecting portion, such as the threaded tail piece 42, with a fluid passage 44 fluidly connecting the bore 40 of the drill string 28 with the chamber 36 of the tool head 32. Another fluid passage 46 can extend from the opposing end of the chamber 36 and terminate at a nozzle 48 aimed to spray the drilling fluid onto or adjacent the bit 33.

Figure 4:
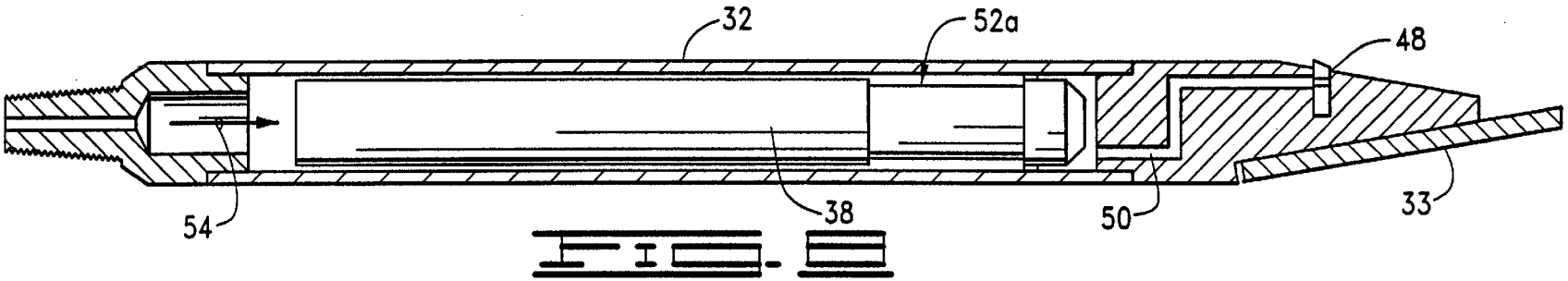
FIG. 4 is a diagrammatic partial cross sectional view of the generator assembly of FIG. 3.
Figure 4:
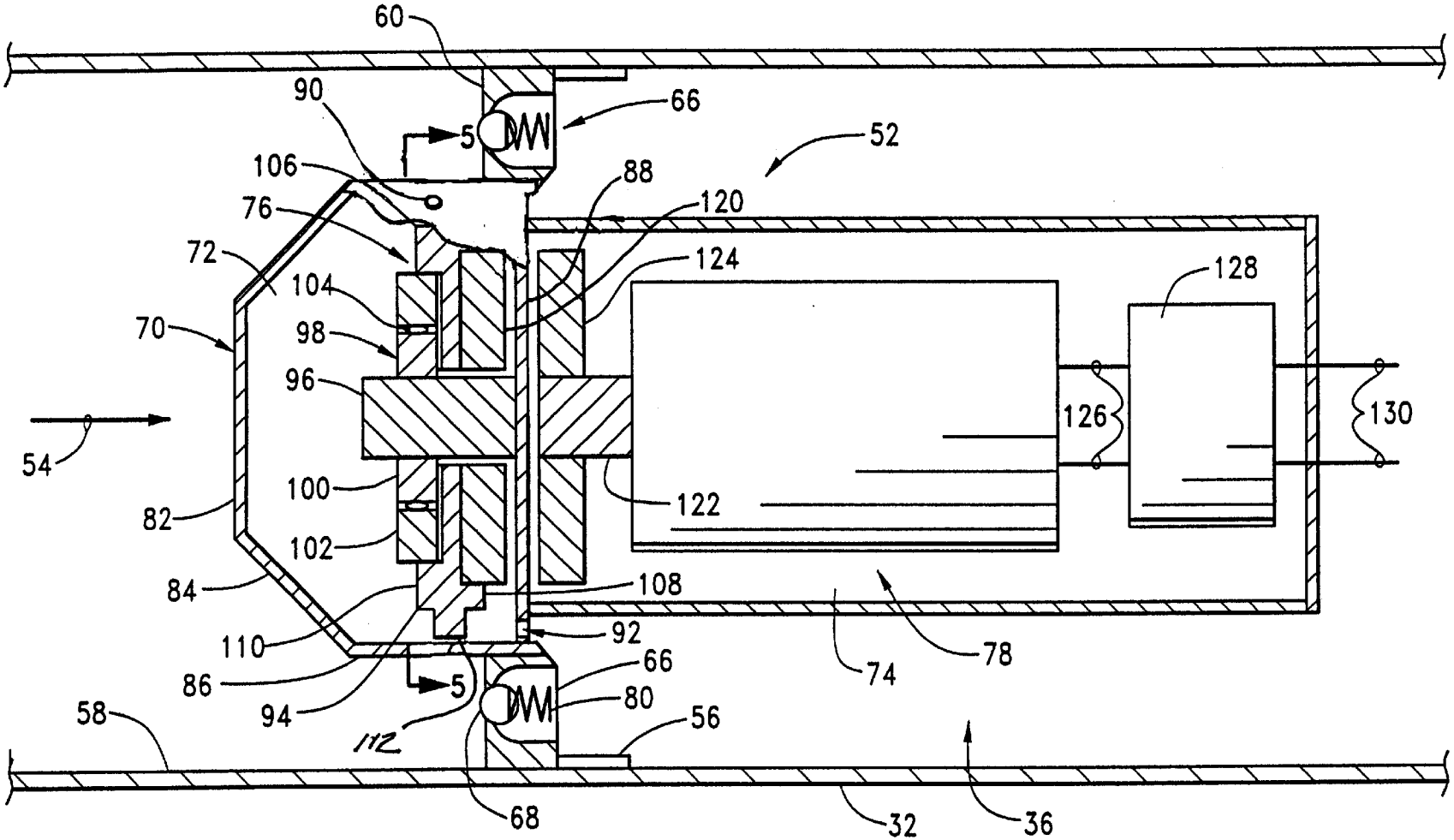

Also disposed in the chamber 36 of the tool head 32 is a generator assembly 52, which is more particularly detailed in the enlarged, cross-sectional view of FIG. 4. The generator assembly 52 utilizes the fluid flowing in the chamber 36 as a motive force to generate power, as described below. Although the embodiment of FIG. 3 discloses the generator assembly 52 preferably contained, within the tool head 32, the present invention is not thus limited, whereas the generator assembly 52 could alternatively be positioned elsewhere within the drill string 28, such as within the bore 40.

In FIG. 4 the drilling fluid flows under pressure in a direction denoted by the reference arrow 54. The generator assembly 52 is preferably adapted for a simple installation into the chamber 36. For example, a stop 56 can depend from an inner surface 58 of the tool head 32. A flange 60 of the generator assembly 52 can thereby be readily positioned to engage the stop 56 so as to operably position the generator assembly 52 within the chamber 36. Conventional retention methods can be used to retain the generator assembly 52 in the operable position.

As mentioned hereinabove and detailed below, the generator assembly 52 uses the drilling fluid as a motive force to generate power. Typically, the generator assembly 52 is adapted to operate within a preselected fluid flow range. Where the drilling fluid flow is thereafter increased above the preselected range, it can be advantageous to provide a bypass for a portion of the fluid flow to substantially stabilize the effective fluid flow acting on the generator assembly 52. That is, the bypass opens at pressures above a preselected threshold pressure to substantially maintain a selected flow at an inlet of the generator assembly 52, as shown below.

One such manner is shown in FIG. 4, where one or more bypass valves 66 are normally closed and selectively openable to control the amount of fluid flow passing therethrough as described hereinbelow. The bypass valve 66 has a sealing member 68 that is biased in the closed position by a spring 80 having a preselected stiffness so as to be responsive to the desired fluid pressure in cracking open the bypass valve 66.

The generator assembly 52 has a housing 70 defining a first cavity 72 and a second cavity 74. The first cavity 72 encloses a turbine assembly 76 and the second cavity 74 encloses an electrical generator 78. The housing 70 preferably forms a leading surface projecting into the fluid flow to direct the fluid toward the flange 60. For example, the housing 70 of FIG. 4 has a tapered leading surface with a blunt nose portion 82 that is substantially transverse to the fluid flow. A tapered transition portion 84 terminates at a rim portion 86 that is substantially parallel to the fluid flow. A bulkhead 88 spans the rim portion 86 and separates the first cavity 72 from the second cavity 74, effectively isolating cavity 74 from the fluid. An inlet 90 and an outlet 92 are provided in the housing 70, such as in the rim portion 86 and the bulkhead 88, respectively.

The pressurized fluid thus flows through the inlet 90 into the cavity 72 where it impingingly engages the turbine assembly 76. Thereafter, an impulse-momentum transfer of energy occurs in transferring fluid velocity to a mechanical rotation of a portion of the turbine assembly 76. The fluid is afterward discharged from the first cavity 72 through the outlet 92. Although for purposes of the present description one inlet 90 is illustrated, it will be understood that two or more inlets 90 can be provided in the housing 70 as a matter of design choice. The selected number of inlets 90 will depend, for example, on the fluid flow requirement necessary to generate electrical energy for the desired signal output or transmitter 38. The desired drilling speed, the type of subterranean conditions, and the type of drilling tool utilized are but a few of the numerous factors determining the fluid delivery rate that must pass through drill string 28 to aid the drilling process. In their combination inlets 90, outlets 92, and bypass valves 66 must be sized to accommodate the maximum flow rate. Of course, in one embodiment where no bypass valve 66 is used then the size and configuration, that is the number and placement, of the inlets 90 and outlets 92 determine the maximum flow rate. On the other hand, the overall design parameters of generator assembly 52 in combination with the desired signal output of transmitter 38 define the minimum acceptable flow rate. As is known by those skilled in the art, the various design parameters of this invention must be adjusted to achieve an acceptable outcome without adversely affecting drilling performance itself. Where two or more inlets 90 are utilized, preferably the inlets 90 would be circumferentially arranged equidistantly in order to balance the loading effect of the multiple fluid inlet streams against the turbine assembly 76. Likewise, although only one outlet 92 is illustrated, two or more outlets 92 can be provided in the housing 70 as a matter of design choice.

Figure 5:
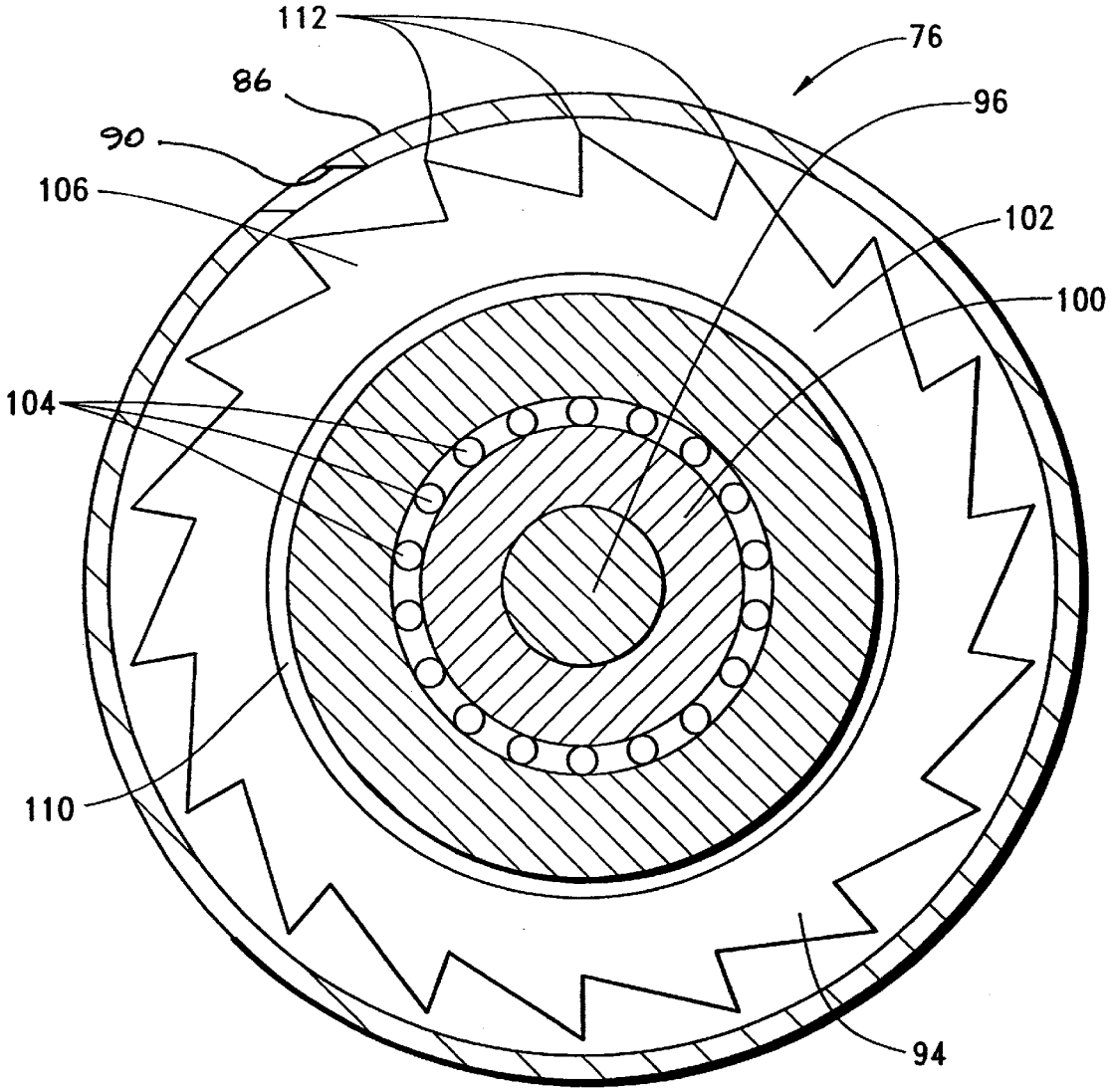
FIG. 5 is a view taken along the line 5—5 of FIG. 4.

The turbine assembly 76 generally has a rotatable impeller that is rotated in response to the impinging engagement of the fluid. For example, FIGS. 4 and 5 show the turbine assembly 76 having a tangential impulse-momentum turbine, or turbine wheel 94 of the Pelton wheel type. A supporting shaft 96 extends from the bulkhead 88 and supports a roller bearing 98. An inner race 100 of the bearing 98 is affixed to the shaft 96 and an outer race 102 orbits the inner race 100 upon a plurality of bearings 104, such as ball bearings, needle bearings, or a hydrodynamic bearing interposed therebetween.

Figure 6:
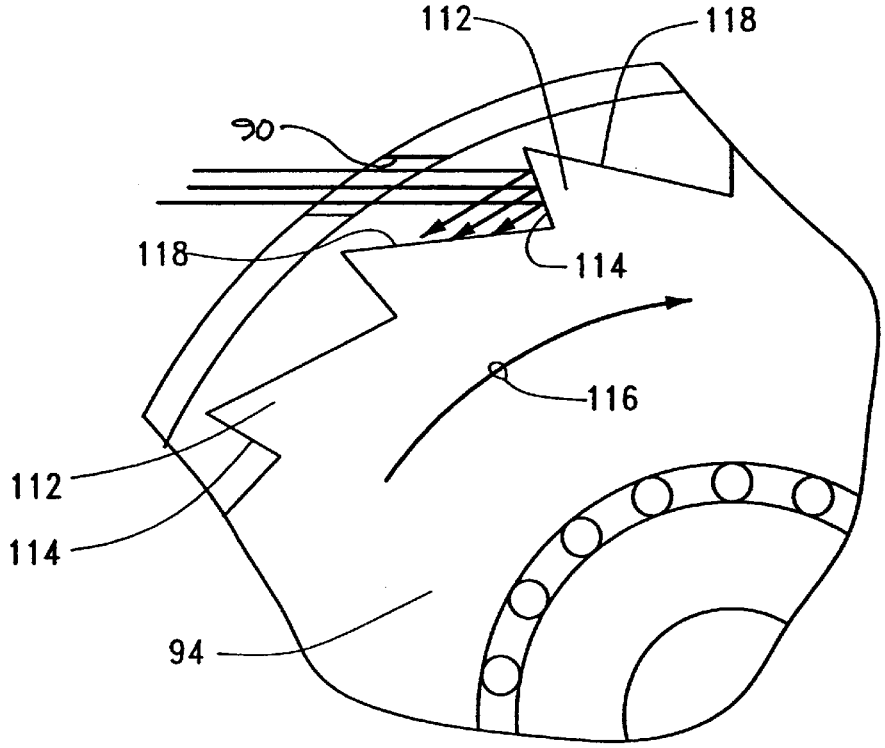
FIG. 6 is an enlarged view of a portion of the turbine wheel of FIG. 5 at a position of the turbine wheel where the motive fluid is operatively impinging one of the vanes of the turbine wheel.

The turbine wheel 94 has a hub 106 supported by the outer race 102 of the bearing 98, thereby supporting the turbine wheel 94 in rotation around the shaft 96. The hub 106 has a first side 108 adjacent the bulkhead 88 and an opposing second side 110, and a plurality of circumferentially arranged, radially extending vanes 112. At any particular rotational position of the turbine wheel 94, one or more vanes 112 are impingingly engaged by the fluid flowing through the inlet 90. FIG. 6 illustrates one particular rotational position of the turbine wheel 94 whereat the fluid impingingly engages a contact surface 114 of the vane 112, thereby imparting a tangential impulse that, in turn, imparts momentum as a mechanical rotation to the turbine wheel 94 in a direction denoted by the arrow 116. It will be noted the inlet 90 is directed substantially orthogonal to the axis of rotation of the turbine wheel 94 around the shaft 96, and is located near the top of the rim portion 86 as shown in FIG. 5 so as to impart a tangential force on the turbine wheel 94.

Figure 7:
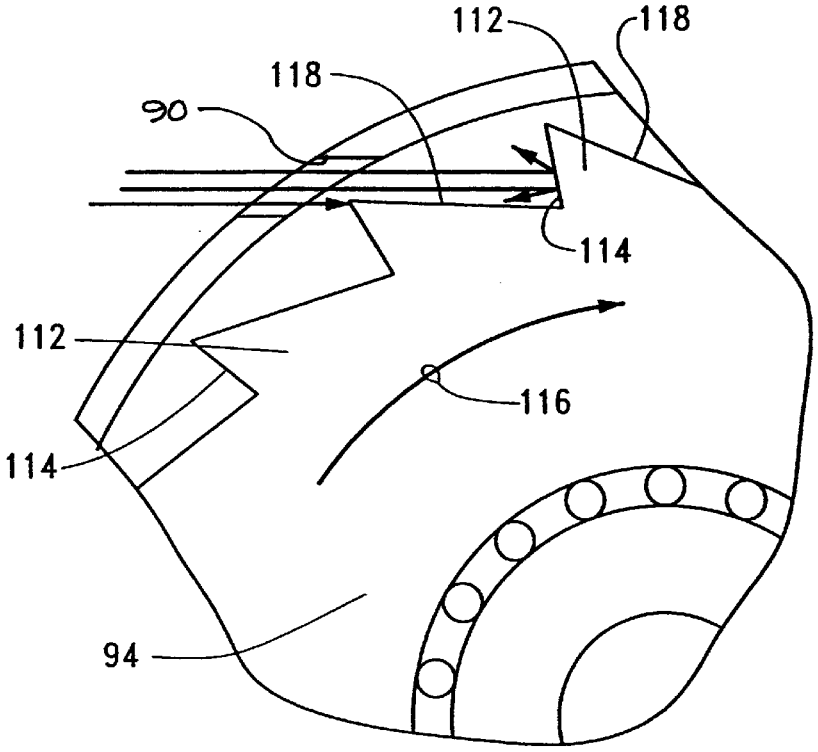
FIG. 7 is a view similar to that of FIG. 6 wherein the turbine wheel has rotated in a clockwise direction such that the motive fluid is simultaneously operatively impinging two of the vanes of the turbine wheel.
Figure 7A:
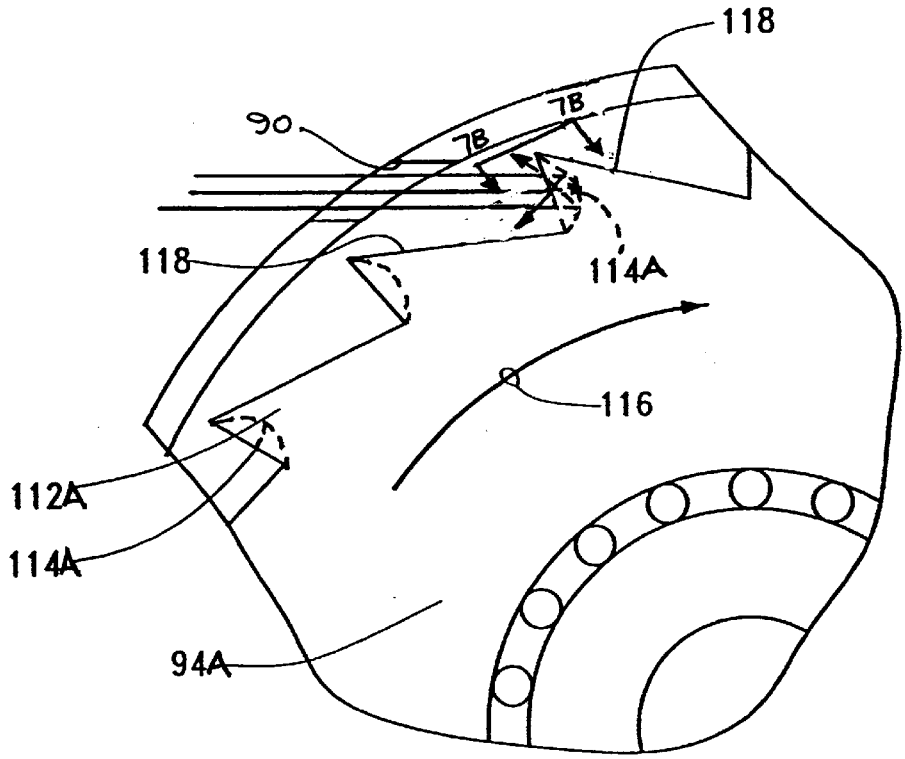
FIGS. 7A and 7B are elevational and top view, respectively, of an alternative turbine wheel having an arcuate shaped contact surface.
Figure 7B:
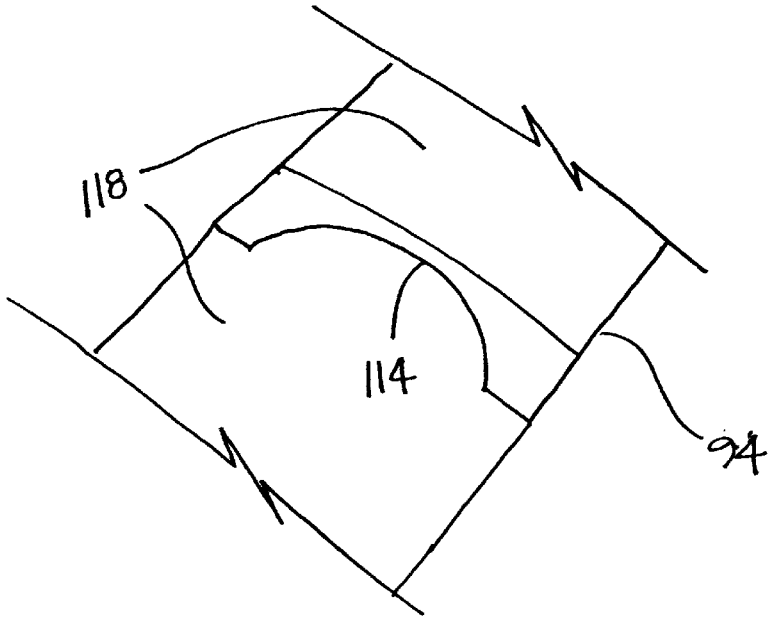
Figure 3:
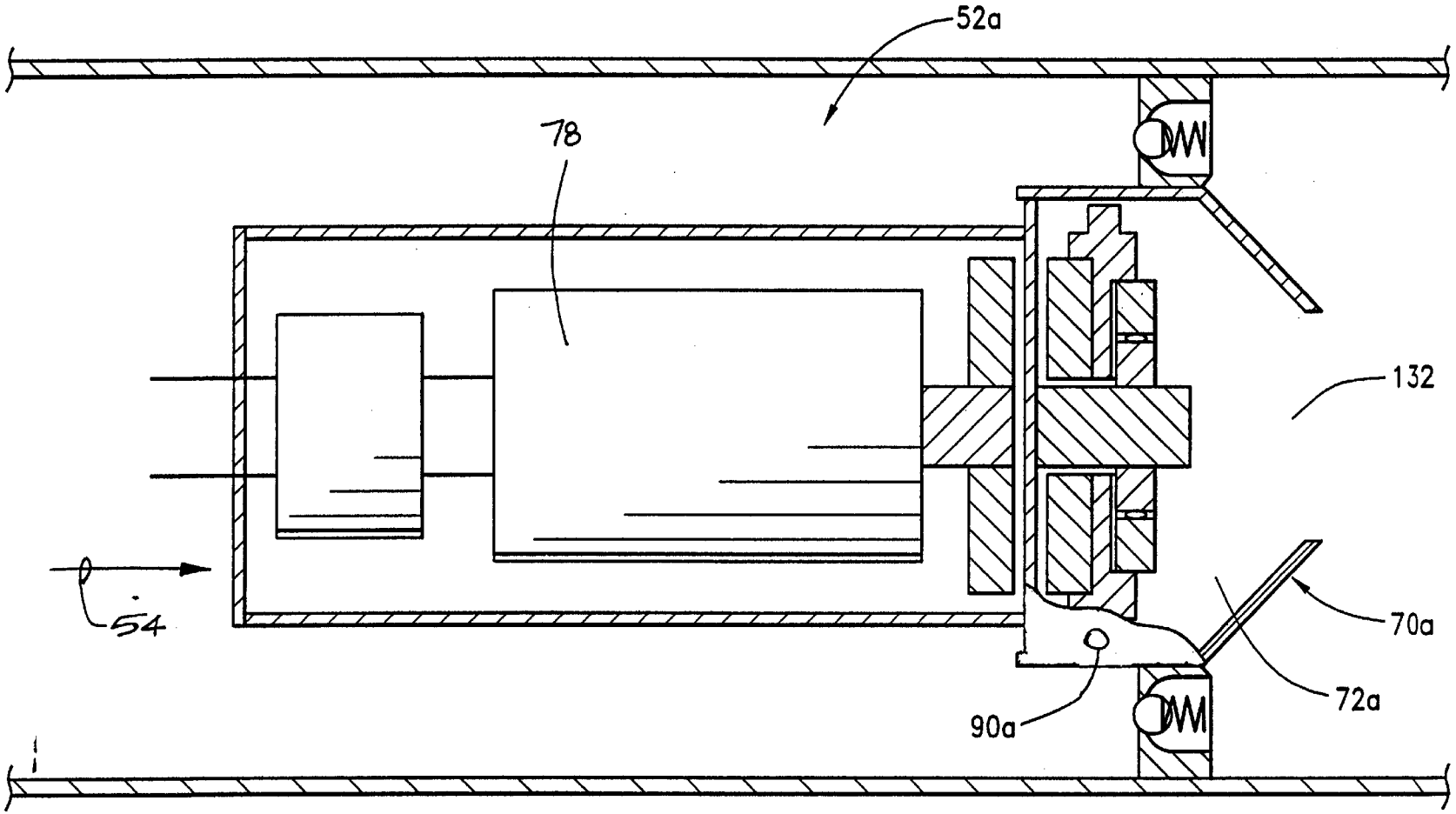

Each of the vanes 112 is formed by an intersection of two radially extending surfaces, the contact surface 114 and a relief surface 118. The contact surface 114 is impingingly engaged by the fluid, but the relief surface 118 is preferably not so impingingly engaged in order to urge the turbine wheel 94 only in the rotational direction 116. FIG. 7 illustrates a subsequent position of the turbine wheel 94, whereat the tip of the adjacent vane 112 first enters the fluid stream flowing through the inlet 90. This view best illustrates the angled relief surface 118 providing the impinging engagement of the fluid against substantially only the contact surfaces 114 of the adjacent vanes 112, so as to urge the turbine wheel 94 only in the rotational direction 116. It will be noted the contact surface 114 of FIGS. 5–7 provides a substantially linear transition surface between adjacent relief surfaces 118. Alternative configurations may be used as well, as is necessary for characteristic fluid flow conditions and/or to meet predetermined torque requirements of the turbine wheel 94, as is conventional with the design and use of a Pelton-type wheel. FIGS. 7A and 7B, for example, show an alternative turbine wheel 94A having vanes 112A. Vanes 112A have an arcuate contact surface 114A providing an enhanced cupping surface for impinging engagement of the fluid stream.

It has been determined that a generator assembly 52 employing no bypass valves 66 and fitted with mechanical bearings can be operated at as little as three gallons-per-minute flow rate and at about 5000 RPM with a pressure drop of about 500 pounds per square inch across the generator assembly 52. The maximum flow rate without a bypass valve 66 is about 10 gallons-per-minute, but the flow rate can be increased to more than two hundred gallons-perminute with the addition of one or more bypass valves 66. These performance examples are illustrative of the spirit of the present invention and are not intended to limit the spirit of the invention in any way to the illustrative embodiments described.

The present invention contemplates transferring this mechanical rotation into power, such as by coupling the rotating turbine wheel 94 to a power generating device, such as the electrical generator 78. For example, returning to FIG. 4, it will be noted that the first side 108 of the hub 106 of the turbine wheel 94 supports a magnetically active member 120 in fixed rotation with the hub 106. As will be seen below, the first magnetically active member 120 is part of a coupling that links the turbine assembly 76 with the electrical generator 78.

The electrical generator 78 in FIG. 4 is supported by the housing 70 within the second cavity 74. Generally, the electrical generator 78 is responsive to the mechanical rotation of the turbine assembly 76 to produce electrical power. For example, the electrical generator 78 of FIG. 4 has a rotatable input shaft 122 that supports a magnetically permeable member 124. The magnetically active members 120, 124 are thus magnetically coupled across the bulkhead 88. To provide this magnetic coupling the bulkhead 88 separating the magnetically active members 120, 124 comprises a magnetically active material. The mechanical rotation of the turbine wheel 94 imparts a mechanical rotation to the shaft 122 to generate an electrical power output from the electrical generator 78. The magnetic coupling is preferred because such an arrangement permits a completely sealed chamber 74 for receivingly disposing the generator assembly 52.

Electrical leads 126 can be electrically connected and switched accordingly to provide electrical power, as required, to other components. For example, the generator assembly 52 of FIG. 4 can be electrically connected to a rechargeable battery 128 which, in turn, can be electrically connected by electrical leads 130 to various electrical devices, such as the transmitter 38 (FIG. 3) Alternatively, the electrical generator 78 can be electrically connected directly to the transmitter 38 (FIG. 3). With an appropriate selection of electrical generator 78 coupled to the turbine assembly 76 as described hereinabove, it has been observed that power ranging from two watts to 15 watts can be generated. This is significantly greater than the power consumed by a conventional battery powered transmitter 38, which is typically about one watt.

FIG. 8 is a partial cross-sectional view of the tool head 32, similar to that of FIG. 3 but illustrating an alternative construction wherein the generator assembly 52*a* is reversed relative to the fluid flow direction indicated by the reference arrow 54. FIG. 9 is a detail cross sectional view of the generator assembly 52*a*. The fluid flows into the inlet 90*a* and is expelled from the cavity 72*a* through an opening 132 in the housing 70*a*. Otherwise, the mechanical rotation of the turbine assembly 76 is coupled to the electrical generator 78 substantially as described above.

Figure 10:
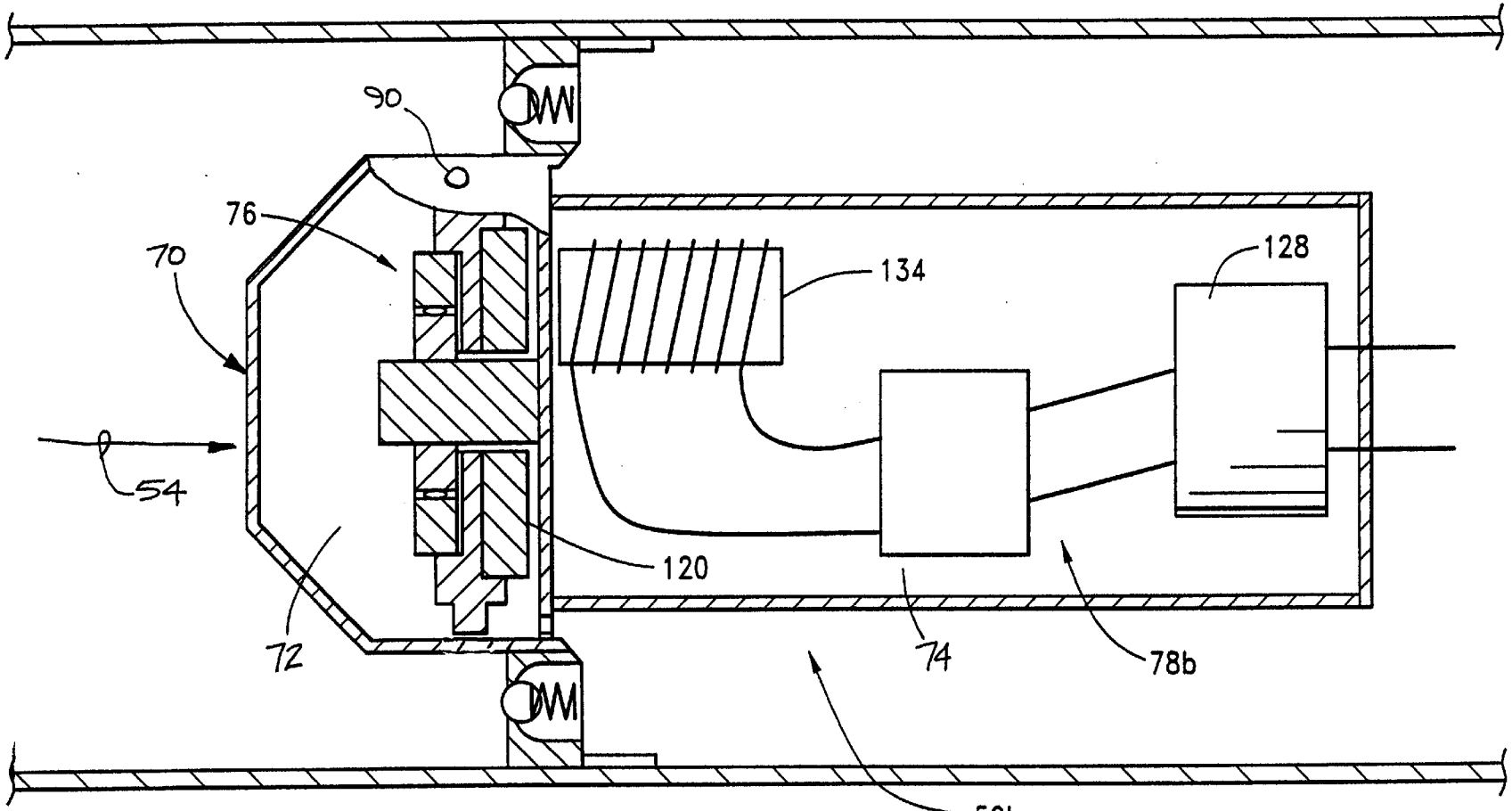
FIG. 10 is a diagrammatic partial cross sectional view of the generator assembly constructed in accordance with an alternative embodiment of the present invention.

FIG. 10 is a generator assembly 52*b* built in accordance with another alternative embodiment of the present invention. The turbine assembly 76 is substantially similar to that previously described. The electrical generator 78*b*, however, has one or more electrical coils 134 positioned operably adjacent the magnetic active member 120 of the turbine assembly 76. The rotation of the magnetic active member 120 excites the coil 134 to produce a current which is used to charge the rechargeable battery 128 or power the transmitter 38 (FIG. 3) directly. In an alternative embodiment the components of the electrical generator 78*b* can be adapted for immersion in the fluid stream, so the portion of the housing 70 enclosing the cavity 74 can be eliminated.

Returning to FIGS. 3 and 8 it will be noted that in a preferred embodiment the generator assembly 52 is attached to the transmitter 38. The generator assembly 52 can be provided so as to replace the end cap of a standard battery powered transmitter which would otherwise retain the batteries within the battery compartment in the transmitter. In a preferred embodiment this attachment to a battery-powered transmitter would be provided by a threading engagement of the generator assembly 52 and the transmitter 38. The downhole generator of the present invention provides more electrical power to the downhole end of a drill string than is available in the current state of the art. Consequently, the present invention enables the use of powered assemblies that are not otherwise practicable in the drilling process. Downhole detection systems such as ground-penetrating radar and gas detectors illustrate devices with power requirements that are greater than what can be practicably satisfied by existing downhole power systems, but which can be readily satisfied by the power-delivery capability of the present invention. It is particularly advantageous to employ such detection systems continuously while drilling. Additional power is also advantageous in times when it is necessary to track the transmitter location both during drilling and during backreaming.

The increased power provided by the present invention furthermore makes possible the use of more sophisticated control systems to enhance the overall drilling process, or selected elements thereof, such as the steering action and/or navigation of tool head 32. Power-hungry digital signal processing chips, for example, can be employed for bi-directional transmission of data to and from the transmitter. Complex integrated circuits can direct and apportion electrical power that is sufficient to operate numerous fluid actuators such as solenoid valves, pumps, switches and relays and the like.

It is clear that the present invention is well adapted to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed and as defined in the appended claims.

What is claimed is:

1. A horizontal directional drilling machine, comprising:

a drill string;

a fluid flow passage to direct fluid along the drill string; and a generator assembly to generate an output power, the generator assembly comprising:

a generator housing supportable by the drill string, the generator housing defining a cavity;

an inlet and an outlet in the generator housing;

a turbine assembly supported in the cavity;

an electric generator driven by the turbine; and a bypass assembly to maintain a substantially constant fluid flow rate through the inlet.

2. The horizontal directional drilling machine of claim 1 comprising a dipole magnetic field transmitter electrically connected to the generator assembly.

3. The horizontal directional drilling machine of claim 1 comprising a ground penetrating radar apparatus electrically connected to the generator assembly.

4. The horizontal directional drilling machine of claim 1 comprising an electrical control circuit electrically connected to the generator assembly.

5. The horizontal directional drilling machine of claim 1 further comprising a tool head joined to the drill string, wherein the generator assembly is supported in the tool head.

6. The horizontal directional drilling machine of claim 1 wherein the turbine assembly is magnetically coupled to the electric generator.

7. The horizontal directional drilling machine of claim 6 wherein the generator housing seals the electric generator from the fluid flow passage.

8. The horizontal directional drilling machine of claim 6 wherein the electric generator comprises a wound coil excitable by rotation of the turbine assembly.

9. The horizontal directional drilling machine of claim 6 wherein the electric generator is electrically connected to a battery.

10. The horizontal directional drilling machine of claim 6 wherein the inlet and the turbine assembly are positioned to cause fluid to impinge the turbine assembly substantially orthogonal to the axis of rotation of the turbine assembly.

11. The horizontal directional drilling machine of claim 10 wherein the turbine assembly comprises a plurality of radially extending vanes.

12. The horizontal directional drilling machine of claim 1 wherein the inlet and the turbine assembly are positioned to cause fluid to impinge the turbine assembly substantially orthogonal to the axis of rotation of the turbine assembly.

13. The horizontal directional drilling machine of claim 12 wherein the turbine assembly comprises a plurality of radially extending vanes.

14. The horizontal directional drilling machine of claim 1 wherein the output power is electrical power.

15. A generator assembly for powering an electric component used with a horizontal directional drilling system, the generator assembly comprising:

a generator housing supportable by the drill string, the generator housing defining a cavity;

an inlet and an outlet in the generator housing;

a fluid driven turbine assembly supported in the cavity;

an electric generator driven by the turbine; and a bypass assembly to maintain a substantially constant fluid flow rate through the inlet.

16. The generator assembly of claim 15 wherein the inlet and the turbine assembly are positioned to cause fluid to impinge the turbine assembly substantially orthogonal to the axis of rotation of the turbine assembly.

17. The generator assembly of claim 16 wherein the turbine assembly comprise a plurality of radially extending vanes.

18. The horizontal directional drilling machine of claim 15 wherein the turbine assembly is magnetically coupled to the electric generator.

19. The horizontal directional drilling machine of claim 18 wherein the inlet and the turbine assembly are positioned to cause the fluid to impinge the turbine assembly substantially orthogonal to the axis of rotation of the turbine assembly.

20. The generator assembly of claim 19 wherein the turbine assembly comprise a plurality of radially extending vanes.

21. The horizontal directional drilling machine of claim 15 wherein the generator housing seals the electric generator.

22. A horizontal directional drilling machine comprising:

a drill string;

a fluid flow passage to direct drilling fluid along the drill string;

a generator assembly supported in the drill string and adapted to generate output power, the generator assembly comprising a turbine assembly magnetically coupled to an electric generator;

a rechargeable battery electrically connected to the generator assembly; and a dipole magnetic field transmitter electrically connected to the rechargeable battery.

23. The horizontal directional drilling machine of claim 22 wherein the generator assembly further comprises:

a generator housing defining a cavity;

an inlet and an outlet in the generator housing; and wherein the turbine assembly is supported in the generator housing so that the inlet is positioned to cause the drilling fluid to impinge the turbine assembly substantially orthogonal to the axis of rotation of the turbine assembly.

24. The horizontal directional drilling machine of claim 22 wherein the generator assembly further comprises:

a generator housing supported by the drill string, the generator housing defining a cavity;

an inlet and an outlet in the generator housing to direct drilling fluid across the turbine assembly; and a bypass assembly to maintain a substantially constant drilling fluid flow rate through the inlet.

25. The horizontal directional drilling machine of claim 24 wherein the turbine assembly is supported within the generator housing so that that the inlet is positioned to cause the drilling fluid to impinge the turbine assembly substantially orthogonal to the axis of rotation of the turbine assembly.

* * * * *

UNITED STATES PATENT AND TRADEMARK OFFICE

CERTIFICATE OF CORRECTION

PATENT NO. : 6,672,409 B1
DATED : January 6, 2004
INVENTOR(S) : Dock et al.

It is certified that error appears in the above-identified patent and that said Letters Patent is hereby corrected as shown below:

Title page,
Item [56], References Cited, U.S. PATENT DOCUMENTS, please add the following references:

| | | | | |
|---|---|---|---|---|
| -- 3583502 | 06/08/71 | Henderson | 175 | 107 |
| 3949354 | 04/06/76 | Claycomb | 340 | 18 |
| 3970877 | 07/20/76 | Russell et al. | 310 | 8.3 |
| 3819293 | 06/25/74 | Zitzmann | 415 | 200 |
| 3982224 | 09/21/76 | Patton | 340 | 18 |
| 3997867 | 12/14/76 | Claycomb | 340 | 18 |
| 4080112 | 03/21/78 | Zimmermann | 417 | 420 |
| RE30246 | 04/01/80 | Richter, Jr. et al. | 175 | 65 |
| 4184545 | 01/22/80 | Claycomb | 166 | 113 |
| 4207485 | 06/10/80 | Silver | 310 | 104 |
| 4215426 | 07/29/80 | Klatt | 367 | 83 |
| 4351037 | 09/21/82 | Scherbatskoy | 367 | 85 |
| 4491738 | 01/01/85 | Kamp | 290 | 43 |
| 4515225 | 05/07/85 | Dailey | 175 | 40 |
| 4518888 | 05/21/85 | Zabcik | 310 | 334 |
| 4532614 | 07/30/85 | Peppers | 367 | 81 |
| 4654537 | 03/31/87 | Gaspard et al. | 290 | 54 |
| 4675852 | 06/23/87 | Russell et al. | 367 | 84 |
| 4725197 | 02/16/88 | Russell et al. | 415 | 104 |
| 4739325 | 04/19/88 | MacLeod | 340 | 854 |
| 4785300 | 11/15/88 | Chin et al. | 340 | 861 |
| 4802150 | 01/31/89 | Russell et al. | 367 | 85 |
| 4844707 | 07/04/89 | Kletschka | 417 | 420 |
| 4847815 | 07/11/89 | Malone | 367 | 84 |
| 5145333 | 09/08/92 | Smith | 417 | 405 |
| 5149984 | 09/22/92 | Schultz | 290 | 54 |
| 5179040 | 01/12/93 | Hattori | 437 | 129 |
| 5182731 | 01/26/93 | Hoelscher et al. | 367 | 84 |
| 5215152 | 06/01/93 | Duckworth | 175 | 48 |
| 5248896 | 09/28/93 | Forrest | 290 | 1 |
| 5285204 | 02/08/94 | Sas-Jaworsky | 340 | 854.9 |
| 5402068 | 03/28/95 | Meador et al. | 324 | 338 |
| 5448227 | 09/05/95 | Orban et al. | 340 | 854.4 |

UNITED STATES PATENT AND TRADEMARK OFFICE

CERTIFICATE OF CORRECTION

PATENT NO. : 6,672,409 B1
DATED : January 6, 2004
INVENTOR(S) : Dock et al.

It is certified that error appears in the above-identified patent and that said Letters Patent is hereby corrected as shown below:

Title page (cont'd),

| | | | | |
|---|---|---|---|---|
| 5583827 | 12/10/96 | Chin | 367 | 84 |
| 5586083 | 12/17/96 | Chin et al. | 367 | 84 |
| 5615172 | 03/25/97 | Kotlyar | 367 | 83 |
| 5695015 | 12/09/97 | Barr et al. | 175 | 45 |
| 5787052 | 07/28/98 | Gardner et al. | 367 | 84 |
| 5812068 | 09/22/98 | Wisler et al. | 340 | 855.5 |
| 5813480 | 09/29/98 | Zaleski, Jr. et al. | 175 | 40 |
| 5818352 | 10/06/98 | McClure | 340 | 854.6 |
| 5839508 | 11/24/98 | Tubel et al. | 166 | 65.1 |
| 3702938 | 11/14/72 | Garnier | 290 | 52 |
| 4732225 | 03/22/88 | Jurgens et al. | 175 | 92 |
| 4956823 | 09/11/90 | Russell et al. | 367 | 84 |
| 5017103 | 05/21/91 | Dahl | 417 | 420 |
| 5195877 | 03/23/93 | Kletschka | 417 | 356 |
| 5322413 | 06/21/94 | Vescovini et al. | 415 | 102 |
| 4601353 | 07/1986 | Schuh et al. | 175/41 | |
| 3077937 | 02/1963 | Tiraspolsky et al. | 175/107 | |
| 5285204 | 02/1994 | Sas-Jaworsky | 175/40 | |
| 3448305 | 06/1969 | Raynal et al. | 175/104 | |
| 4515225 | 05/1985 | Dailey | 175/40 | |
| 5517464 | 05/1996 | Lerner et al. | 175/45 | |
| 3036645 | 05/1962 | Rowley | 175/104 | |
| 4415823 | 11/1983 | Jurgens | 310/112 | |
| 2940039 | 06/1960 | Yost et a. | 175/107 | |
| 5934371 | 08/1999 | Bussear et al. | 166/53 | |
| 4734892 | 03/1988 | Kotlyar | 175/40 | |
| 6265786 | 07/2001 | Bosley et al. | 290/46 | |
| 4809510 | 03/1989 | Gaspard et al. | 60/648 | |
| 4499955 | 02/1985 | Campbell et al. | 175/46 -- | |

Column 2, line 7 through Column 3, line 22,
Move section entitled "BACKGROUND OF THE INVENTION" to Column 1, line 13.

Column 5,
Line 13, delete "or" and substitute therefor -- of --.
Line 16, after "fluid" insert -- flow --.

UNITED STATES PATENT AND TRADEMARK OFFICE

CERTIFICATE OF CORRECTION

PATENT NO. : 6,672,409 B1
DATED : January 6, 2004
INVENTOR(S) : Dock et al.

It is certified that error appears in the above-identified patent and that said Letters Patent is hereby corrected as shown below:

Column 6,
Line 30, delete "perminute" and substitute therefor -- per-minute --.

Column 7,
Line 1, after "(FIG.3)" insert -- . --.

Signed and Sealed this

Thirty-first Day of August, 2004

JON W. DUDAS
*Director of the United States Patent and Trademark Office*